US006234188B1

(12) United States Patent
Moore, Jr.

(10) Patent No.: US 6,234,188 B1
(45) Date of Patent: May 22, 2001

(54) VACUUM ADAPTER FOR MAINTAINING FLUID IN A VESSEL

(75) Inventor: James E. Moore, Jr., San Antonio, TX (US)

(73) Assignee: Prism Enterprises, Inc., San Antonio, TX (US)

( * ) Notice: Subject to any disclaimer, the term of this patent is extended or adjusted under 35 U.S.C. 154(b) by 0 days.

(21) Appl. No.: 09/313,687

(22) Filed: May 18, 1999

(51) Int. Cl.[7] ..... F16C 17/00

(52) U.S. Cl. ..... 137/14; 137/550; 137/565.23; 137/625.41; 184/1.5; 251/351

(58) Field of Search ..... 184/1.5; 137/565.23, 137/625.41, 351, 550, 14

(56) References Cited

U.S. PATENT DOCUMENTS

| | | | | |
|---|---|---|---|---|
| 757,895 | | 4/1904 | Davis . | |
| 2,692,718 | | 10/1954 | Hall | 226/129 |
| 2,874,733 | | 2/1959 | Sesler et al. | 141/87 |
| 3,509,909 | * | 5/1970 | Bender et al. | 137/625.41 |
| 3,621,870 | | 11/1971 | Harchol et al. | 137/322 |
| 4,109,346 | | 8/1978 | Strozier | 16/151 |
| 4,119,117 | * | 10/1978 | Winkelvoss | 137/456 |
| 4,461,328 | | 7/1984 | Kenney | 141/67 |
| 4,886,568 | | 12/1989 | Strozier | 156/443 |
| 4,909,889 | | 3/1990 | Strozier | 156/443 |
| 5,074,380 | * | 12/1991 | Bedi et al. | 184/1.5 |
| 5,111,854 | | 5/1992 | Begley et al. | 141/65 |
| 5,117,864 | | 6/1992 | Byers | 137/561 A |
| 5,263,520 | | 11/1993 | Arai | 141/65 |
| 5,316,059 | | 5/1994 | Lahnan et al. | 141/340 |
| 5,329,982 | | 7/1994 | Payne . | |
| 5,421,380 | | 6/1995 | Campbell | 141/65 |
| 5,469,898 | | 11/1995 | Campbell | 141/65 |
| 5,476,154 | | 12/1995 | Sage | 184/1.5 |
| 5,579,811 | | 12/1996 | Hsu | 141/98 |
| 5,601,711 | | 2/1997 | Sklar et al. . | |
| 5,657,800 | | 8/1997 | Campbell | 141/98 |
| 5,694,989 | | 12/1997 | Kupelian | 141/65 |
| 5,704,383 | | 1/1998 | Kammeraad et al. | 137/15 |
| 5,727,418 | | 3/1998 | Strozier | 72/457 |
| 5,960,907 | | 10/1999 | Chau . | |

* cited by examiner

*Primary Examiner*—A. Michael Chambers
(74) *Attorney, Agent, or Firm*—Leydig, Voit & Mayer, Ltd.

(57) ABSTRACT

An adapter for connection to an opening in a fluid containing vessel for applying a vacuum to the interior of the vessel is provided. The adapter includes at least partially concentrically disposed outer and inner sleeves, each having a generally conical shape and a generally radially extending opening in a side wall thereof. The inner and outer sleeves are rotatable relative to each other such that the extent to which the openings in the side walls of the inner sleeve and outer sleeve are aligned can be selectively adjusted. The inner and outer sleeves define a passage through the adapter extending from a proximal opening at a proximal end to a distal opening at a distal end of the adapter. The proximal end of the adapter is configured for connection to a vacuum source and the distal end is configured for insertion in and to sealingly engage the edge of the opening in the vessel.

20 Claims, 4 Drawing Sheets

VACUUM ADAPTER FOR MAINTAINING FLUID IN A VESSEL

FIELD OF THE INVENTION

This invention generally relates to a device which can be used to maintain fluid in a vessel when a drain or the like is opened and, more particularly, to an adapter which can be selectively attached to a fluid-containing vessel, such as an engine crankcase filled with motor oil, so as to enable a vacuum to be applied to the interior of the vessel in order to maintain the fluid in the vessel.

BACKGROUND OF THE INVENTION

Changing the oil in a motor vehicle and checking the drain cap or gasket on the engine crankcase frequently results in spilling of oil onto both the ground and the hands of the person removing the drain cap. As can be appreciated, cleaning up after such spills can be time-consuming and a nuisance. Additionally, in many instances, a stripped drain cap or a ruined or worn drain cap gasket is not discovered until after the engine crankcase is filled with new oil. In such circumstances, the new oil must be drained out of the crankcase in order to enable replacement of the drain cap. Similarly, other repairs to the crankcase can also require the removal of the engine oil. Draining the oil in these situations can lengthen the time necessary for performing the repairs and can result in the waste of some or all of the oil, if it cannot be recycled for later use.

Thus, a need exists for a device which helps to prevent spilling of oil when the crankcase drain cap is removed to change the oil and eliminates the need to drain the oil from the crankcase when performing repairs to the crankcase. Because of the wide variety of different types and sizes of motor vehicles, in order to enable such a device to be cost-effective, it preferably should be readily adaptable to any size engine (i.e. any crankcase capacity) and any size engine oil filler opening. Moreover, such a device should not require an investment in any costly machinery or equipment, but instead should be useable with equipment already commonly found in automotive repair shops.

OBJECTS AND SUMMARY OF THE INVENTION

Accordingly, in view of the foregoing, it is a general object of the invention to provide a device which can prevent fluid from flowing out of, or control the rate of flow of fluid out of, a vessel, such as for example an automotive engine crankcase, when a drain or the like is opened or removed from the vessel.

Another object of the present invention is to provide a device for maintaining fluid in a vessel such as described above which can be used with vessels of varying capacity and configuration.

A further object of the invention is to provide a device for maintaining fluid in a vessel which can be used in a cost effective manner with standard equipment commonly found in automotive repair shops.

The present invention provides these and other advantages and overcomes the drawbacks of the prior art by providing an adapter for connection to an opening in a fluid containing vessel for applying a vacuum to the interior of the vessel. The adapter includes an outer sleeve having an opening in a side wall thereof. The adapter further includes an inner sleeve arranged at least partially within the outer sleeve. The inner sleeve also has an opening in a side wall thereof. The inner and outer sleeves are rotatable relative to each other such that the extent to which the opening in the side wall of the inner sleeve and the opening in the side wall of the outer sleeve may be selectively aligned and adjusted.

When assembled together, the inner and outer sleeves define a passage through the adapter extending from a proximal opening at a proximal end to a distal opening at a distal end of the adapter. The proximal end of the adapter is configured for connection to a vacuum source while the distal end is configured for insertion into and sealing engagement with the edge of the opening in the vessel.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
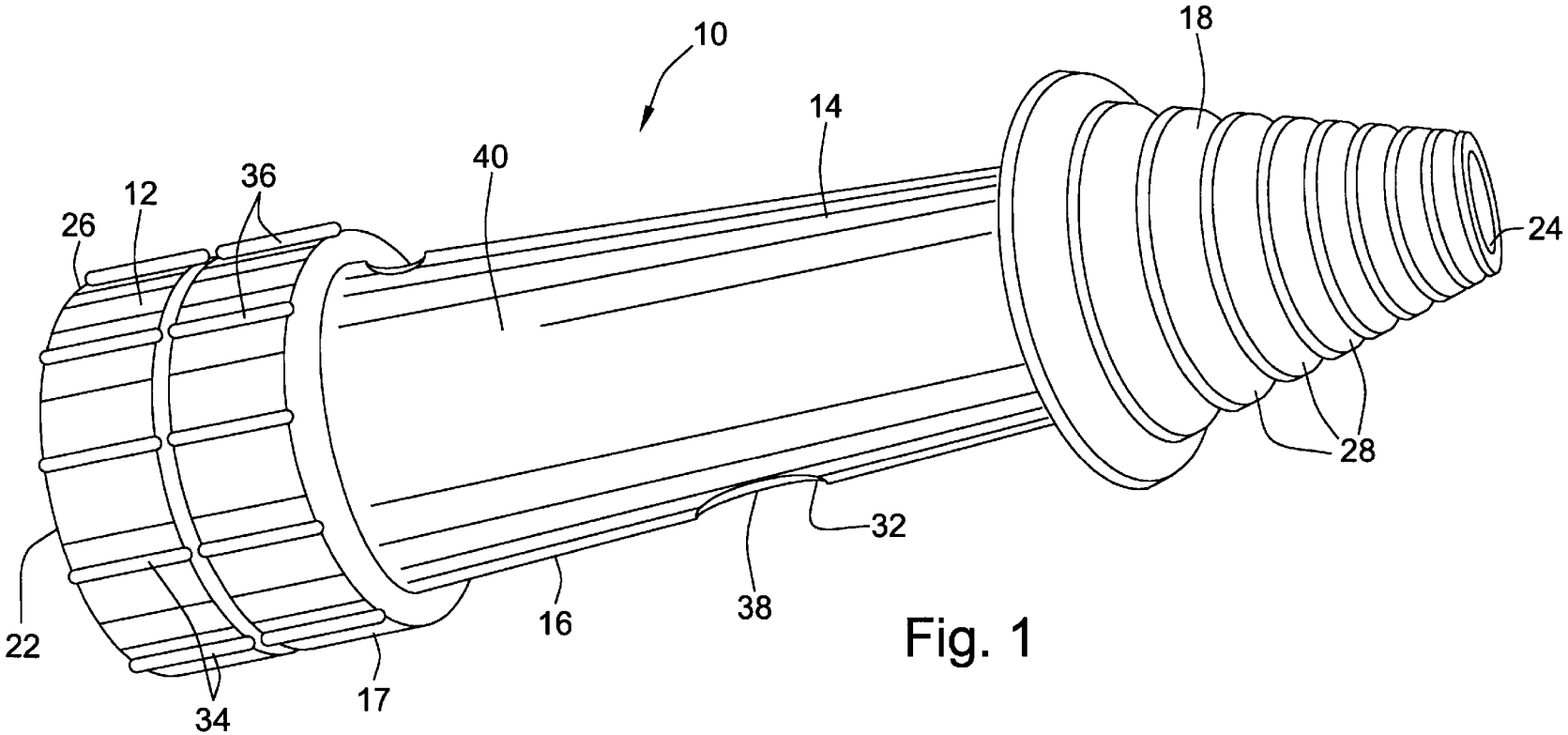
FIG. 1 is a perspective view of an illustrative embodiment of an adapter constructed in accordance with teachings of the present invention which can be selectively attached to a fluid containing vessel so as to enable a vacuum to be applied to the interior of the vessel.
Figure 3:
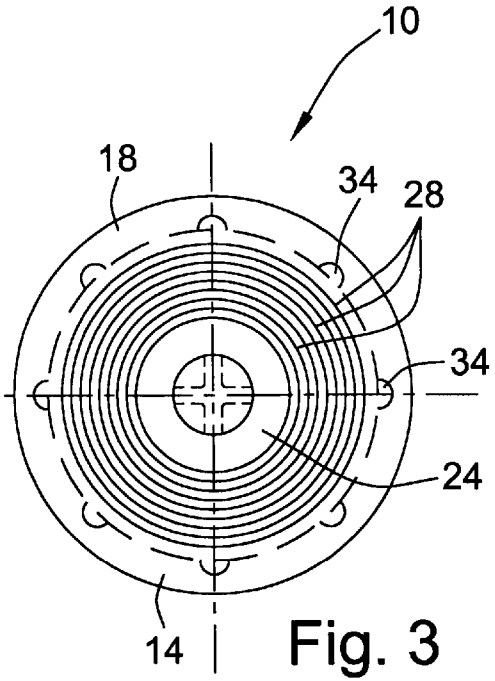
FIG. 3 is an end elevation view of the proximal end of the illustrative vacuum adapter of FIG. 1.

Referring now more particularly to FIG. 1 of the drawings there is shown an illustrative adapter 10 embodying the present invention which enables a vacuum to be applied to a fluid-containing vessel (not illustrated), such as an engine crankcase, so as to prevent the fluid from flowing out when a drain or the like in the vessel is opened or removed. When used in the context of changing the oil in a motor vehicle, the adapter 10 helps to prevent messy oil spills including spills onto a mechanic's hands. Additionally, the adapter 10 enables a mechanic to check or replace the drain cap or drain cap gasket without removing all of the oil from the crankcase. Accordingly, the repairs to the crankcase can be performed more quickly and without any waste of the engine oil. While the present invention is described in connection with the oil in the engine crankcase of a motor vehicle, it will be readily appreciated that the invention is equally applicable to other types of fluid-containing vessels including, for example, hydraulic fluid reservoirs.

In accordance with the invention, the adapter 10 has a proximal end 22 that may be coupled to a vacuum source (not shown) and a distal end 24 that may be inserted into and sealingly engaged with an opening in the vessel. The adapter 10 generally comprises an inner sleeve member 12 and an outer sleeve member 14, as shown in FIG. 2.

Figure 7:
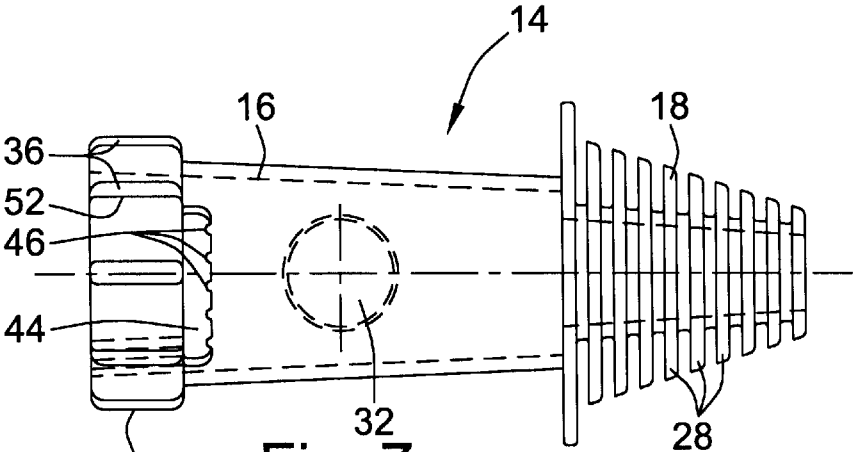
FIG. 7 is a side elevation view of the outer sleeve of the vacuum adapter of FIG. 1.
Figure 9:
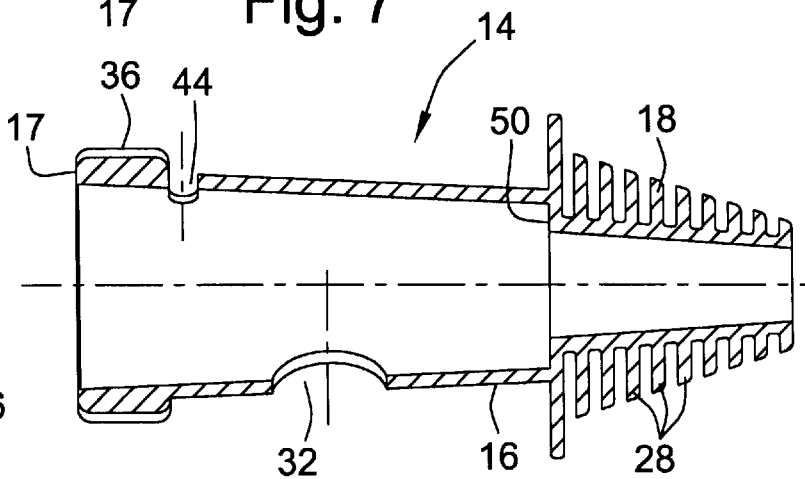
FIG. 9 is a side sectional view of the outer sleeve of the vacuum adapter of FIG. 1.

As shown most clearly in FIGS. 7 and 9, the outer sleeve member 14 includes a truncated conical shaped body section 16 having a proximal end 17 and a distal section 18. In one preferred embodiment, the outer sleeve member 14 is constructed of a soft thermoplastic elastomer.

Figure 5:
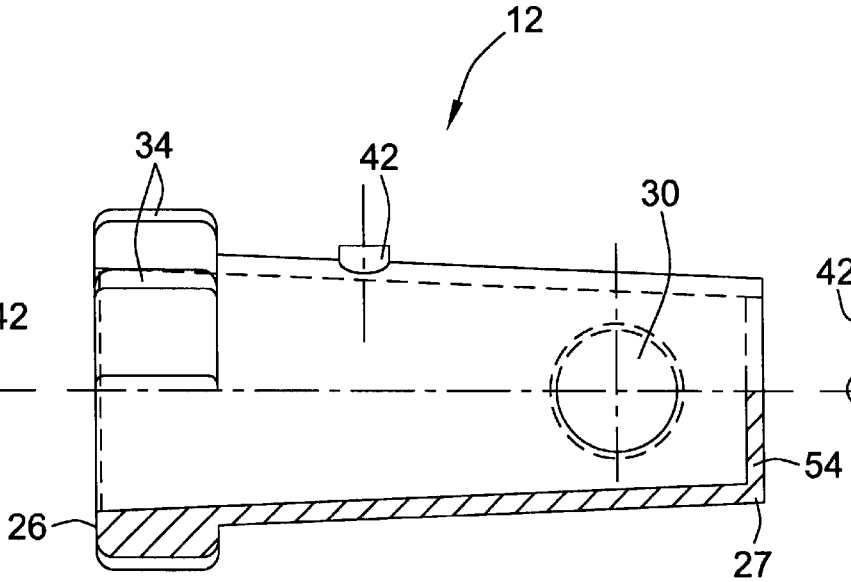
FIG. 5 is a partially cut away side elevation view of the inner sleeve of the vacuum adapter of FIG. 1.

As shown most clearly in FIG. 5, the inner sleeve member 12 also has a generally truncated conical shape having a proximal end 26 and a distal end 27. In one preferred embodiment, the inner sleeve member 12 is constructed of a rigid PVC plastic material.

Figure 2:
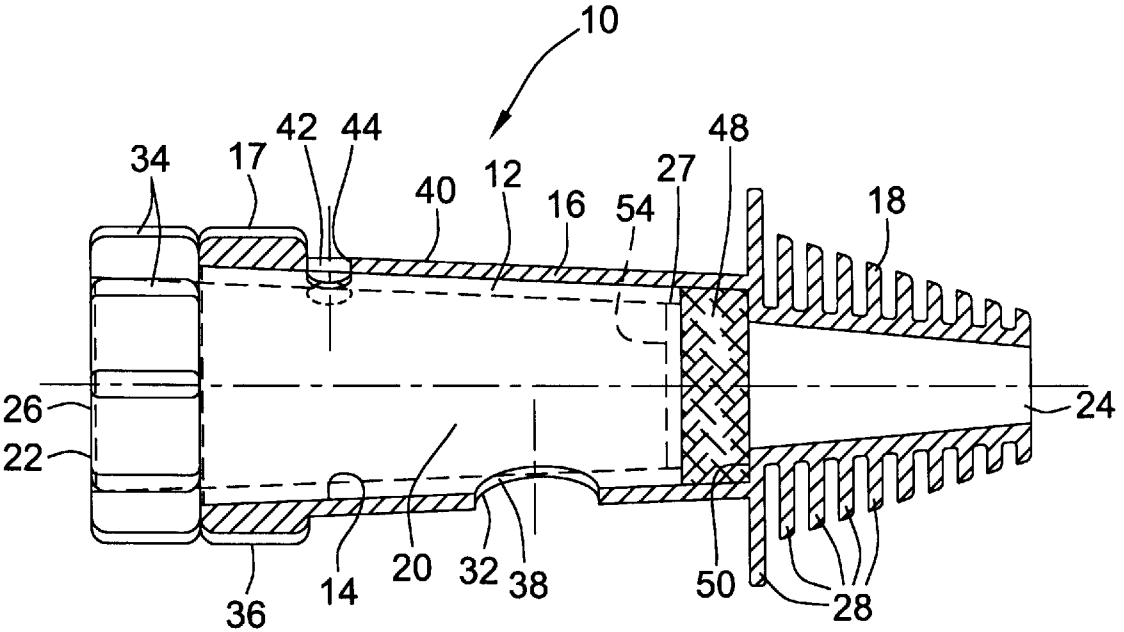
FIG. 2 is a side partial sectional view of the illustrative vacuum adapter of FIG. 1, the outer sleeve member being sectioned.

When the inner and outer sleeves 12, 14 are assembled together, the inner sleeve member 12 is disposed within and in spaced relation radially inward from the body section 16 of the outer sleeve member 14 as shown in FIG. 2. In the assembled adapter, the inner and outer sleeves 12, 14 define a central passage 20 which extends longitudinally through the adapter 10 from an opening at a proximal end 22 of the adapter 10 to an opening at a distal end 24 of the adapter 10.

In order to enable a vacuum to be applied to the adapter 10, the proximal end 22 of the adapter is configured for connection to a vacuum source. More specifically, in the illustrated embodiment, the proximal end 26 of the sleeve member 12 is configured to receive an attachment on the end of the hose of a conventional vacuum cleaner (not shown) such as is commonly used in automotive repair shops. That is, the proximal end 22 of the adapter 10 can be configured to be coupled to an attachment on the hose of a conventional household, automotive repair center, or shop vacuum cleaner. Since the adapter 10 of the present invention can utilize a conventional vacuum cleaner as a vacuum source, using the adapter does not require an investment in costly equipment or machinery. Of course, those skilled in the art will appreciate that the proximal end 22 of the adapter 10 can be configured to connect to any type of vacuum source.

In order to transmit the vacuum to the fluid containing vessel, the distal end 24 of the adapter 10 is adapted for sealing engagement with the opening of the vessel. When using the present invention on an engine crankcase, the distal end 24 of the adapter 10 is connected to the engine oil filler opening on the valve cover by inserting the distal end 24 of the adapter 10 in the oil filler opening. As will be appreciated by those skilled in the art, because of the wide variety of different makes and models of automobiles, engine oil filler openings can have a variety of different sizes and configurations.

Figure 10:
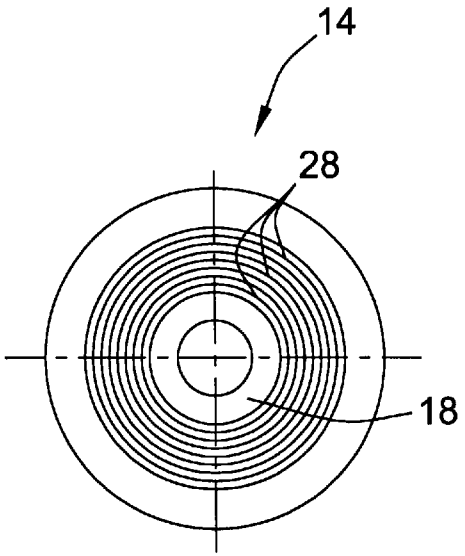
FIG. 10 is an end elevation view of the distal end of the outer sleeve of the vacuum adapter of FIG. 1.

To facilitate connection of the adapter 10 to engine oil filler openings of different sizes, the distal end 24 of the adapter 10 is configured so as to be insertable in and sealingly engageable with the edges of oil filler openings of varying size. In order to ensure that the distal end 24 of the adapter 10 can be inserted in and sufficiently seal oil filler openings of varying size, the outlet section 18 of the outer sleeve member 14, which defines the distal end 24 of the illustrated adapter 10, includes a plurality of concentric rings 28. As shown in FIGS. 9 and 10, the rings are longitudinally spaced from one another and extend from and encircle the outer surface of the adapter 10 as shown in FIGS. 9 and 10. The concentric rings 28 vary in size, with the rings becoming larger in diameter the farther they are positioned from the distal end 24 of the adapter 10.

This configuration enables the distal end 24 of the adapter 10 to be insertable into openings of different size simply by varying the extent to which the distal end 24 extends into the opening. For example, one or two of the rings 28 may be inserted into a relatively small opening, while a greater number of rings 28 may be inserted into a larger opening. The concentric rings 28 ensure that the adapter 10 establishes a sufficient seal with the edges of the opening so as enable a vacuum to be applied to the vessel and thereby create a negative pressure therein. To this end, the concentric rings 28 are preferably constructed of a relatively soft, pliable, resilient material, such as for example a soft thermoplastic elastomer, so that a particular concentric sealing ring may adapt to any imperfections in the surface of the opening in the vessel to provide an effective seal.

In order to allow the adapter 10 to be used on containers of varying capacity and to prevent the fluid in the vessel from being drawn into the vacuum source, the adapter 10 is adjustable so as to allow the strength of the vacuum applied to the vessel to be varied. Specifically, in the illustrated embodiment, the inner and outer sleeves 12, 14 each have a bore 30, 32 which extends substantially radially through the respective wall of the sleeve. Additionally, the inner and outer sleeves 12, 14 are rotatable relative to each other about their common longitudinal axis such that the extent to which the bores 30, 32 in the respective walls of the inner and outer sleeves 12, 14are aligned can be varied.

By varying the extent to which the bores 30, 32 are aligned, an opening 38 of variable size which extends through the side wall 40 of the adapter 10 into the central passage 20 can be created. It will be appreciated by those skilled in the art that this opening 38 can be used to bleed off a portion of the vacuum force created by the vacuum source and thereby adjust the strength of the vacuum applied to the vessel. Thus, the adapter 10 can be easily adjusted to maintain the fluid in vessels which have different capacities while at the same time preventing fluid from being drawn out of the vessel and into the vacuum source.

In the context of engine crankcases, this adjustablity is significant because of the variety of engine sizes found in motor vehicles which result in crankcases having numerous different volumes. The ability to adjust the vacuum force also enables the adapter to be used to control the flow rate at a drain or other opening in the vessel. Again, in the context of changing the oil in a motor vehicle, this would enable a mechanic to adjust the rate at which the oil is flowing out of the drain so as to help avoid spills.

As shown in FIG. 2, the proximal end 26 of the inner sleeve member 12 preferably extends beyond the outer sleeve member 14. To facilitate rotation of the inner and outer sleeve members 12, 14, each sleeve is provided with a plurality of circumferentially spaced ridges 34, 36 on the outer surface at the proximal ends 26, 17 of the respective side walls of the sleeves 12, 14. The respective sets of ridges 34, 36 on proximal ends 26, 17 of the inner and outer sleeve members 12, 14 can be easily grasped by an operator in order to selectively rotate the sleeve members 12, 14 relative to each other. In the illustrated embodiment, the ridges 34, 36 on the inner and outer sleeve members 12, 14 are disposed in alignment adjacent the proximal end 22 of the adapter 10 as shown in FIGS. 1 and 2. The relative alignment of these ridges 34, 36 is preferably used to indicate the fully open or aligned and fully closed or misaligned position of the bores 30, 32.

Figure 6:
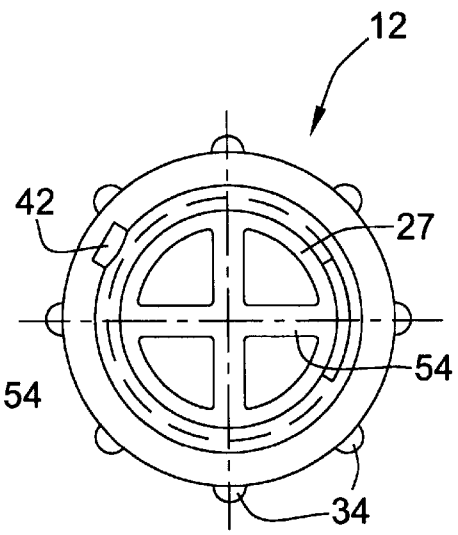
FIG. 6 is an end elevation view of the distal end of the inner sleeve of the vacuum adapter of FIG. 1.
Figure 4:
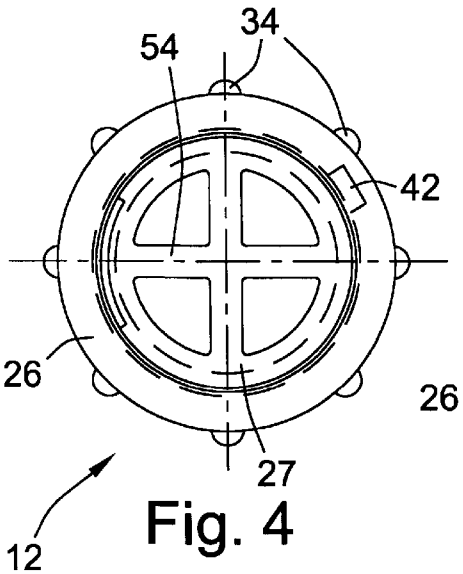
FIG. 4 is an end elevation view of the proximal end of the inner sleeve of the vacuum adapter of FIG. 1.
Figure 8:
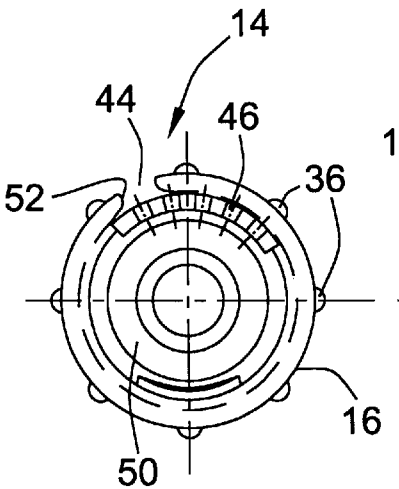
FIG. 8 is an end elevation view of the proximal end of the outer sleeve of the vacuum adapter of FIG. 1.

To further facilitate adjustment of the strength of the vacuum applied to the vessel, the adapter 10 is preferably configured to allow a limited range of relative motion between the inner and outer sleeves 12, 14 between the full alignment of the bores 30, 32 and complete misalignment of the bores 30, 32. As shown in FIGS. 4–6, the inner sleeve member 12 includes a post 42 which extends from the outer surface of the side wall of the inner sleeve and is received in an elongated slot 44 which extends through the side wall of the outer sleeve member 14. To facilitate assembly of the inner and outer sleeves 12, 14, as shown most clearly in FIG. 8, the proximal end 17 of the outer sleeve 14 is preferably provided with a generally axially extending slot 52 through which the post 42 may be advanced as the inner sleeve 12 is assembled into the outer sleeve 14.

As shown in FIG. 7, the slot 44 is preferably provided with a plurality of notches 46 formed therein which have configurations which are complementary to the post 42 on the inner sleeve member 12. Through the engagement of the post 42 with the various notches 46, the inner and outer sleeve members 12, 14 can be secured in several different predetermined relative rotational positions and, accordingly, levels of vacuum.

In order to provide additional protection against fluid from a vessel being drawn into the vacuum source, the adapter 10 includes a filter 48, as shown in FIG. 2, which permits the passage of air, but blocks the flow of liquid from the vessel through the adapter 10. Of course, in order to enable the vacuum to be applied to a vessel, the filter 48 should be constructed so as to block the flow of liquids through the adapter from the distal end to the proximal end but should permit sufficient air flow to allow a negative pressure to be established in a vessel. In one preferred embodiment, this is accomplished by constructing the filter 48 of polyester spun-bonded fibers. In the illustrated embodiment, the filter 48 comprises a cylindrical disk which is arranged within the inner sleeve member 12 and abuts against a flange 50 adjacent the distal section 18 of the outer sleeve member 14.

The distal end 27 of the inner sleeve 12, preferably abuts the filter 48 in order to hold the filter 48 in position against the flange 50 of the outer sleeve 14. In order to securely maintain the filter 48 in position as the vacuum is applied, the distal end 27 of the inner sleeve 12 is provided with one or more restraining arms 54 which interrupt an otherwise open bore through the distal end 27. In the embodiment illustrated, the arms 54 are in the form of four radially extending arms 54. The arms 54, however, may have a different structure. For example, a single generally diametrically extending arm or an arm forming a chord or a segment of a circle may be provided.

It will be appreciated by those skilled in the art that during assembly, the filter 48 is first assembled into the outer sleeve against the flange 50. The inner sleeve 12 is then assembled into the outer sleeve 14, the post 42 passing through the slot 52 along the proximal end 17 of the outer sleeve 14. As the inner sleeve 12 moves into position in the outer sleeve 14, the distal end 27 and arms 54 of the inner sleeve 12 contact the filter 48 to maintain it in position. The inner and outer sleeves 12, 14 may then be rotated relative to one another to provide or adjust the opening 38. Should the filter 48 become saturated during use, the adapter 10 may be disassembled by reversing these steps in order to remove and replace the filter 48.

To use the adapter 10 to control, for example, the flow of oil from an engine crankcase, the proximal end 22 of the adapter is simply connected to a hose or the like which communicates with a vacuum source such as a conventional vacuum cleaner. The distal end 24 of the adapter can then be inserted into the oil filler opening on the valve cover. The distal end 24 of the adapter 10 should be inserted into the oil filler opening to such an extent that a relatively tight seal is established around the opening via the concentric rings 28.

The vacuum source can then be turned in order to establish a negative pressure within the crankcase. If oil is being drawn from the crankcase and into the filter 48 in the adapter, the strength of the vacuum applied to the crankcase should be lowered via rotating the inner and outer sleeve 12, 14 members relative to each other so as to enlarge the opening 38 in the side wall 40 of the adapter 10 formed by the bores 30, 32 in the inner and outer sleeves 12, 14. Once the negative pressure is established within the crankcase, the drain cap can then be removed and no oil will flow out of the drain opening. If some oil does flow out of the drain opening, the vacuum applied to the crankcase can be strengthened via rotating the inner and outer sleeve members 12, 14 so as to decrease the size of the opening 38 in the side wall 40 of the adapter. Alternatively, when changing the oil in the engine, the rate of the flow of oil through the drain opening can be regulated by the adapter 10 so as to control spills, again, simply by rotating the inner and outer sleeve members 12, 14 relative to each other.

From the foregoing it can be seen that a vacuum adapter has been provided which can be used to effectively maintain the fluid in, or control the flow of fluid from, a vessel when a drain or the like is opened in the vessel. The adapter can be inserted in vessel openings of varying size. Additionally, the adapter allows the strength of the vacuum which is applied to the vessel to be easily adjusted, thereby enabling the adapter to be used with vessels of varying capacity. Because the adapter can be configured to be used with a conventional vacuum cleaner such as is commonly found in a automotive repair shop, the adapter is also quite cost effective.

While this invention has been described with an emphasis upon preferred embodiments, it will be appreciated by those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A method for maintaining fluid in the interior of a fluid containing vessel when a vessel flow opening is created below a level of fluid within the vessel, the method comprising the steps of:

coupling a proximal end of an adapter body having a passage extending therethrough to a vacuum source such that a proximal opening into the passage is in flow connection with the vacuum source, sealingly engaging a distal end of the adapter body with an opening in the vessel, the opening being disposed above the fluid level, such that a distal opening into the passage is in flow connection with the vacuum source, activating the vacuum of the vacuum source to apply the vacuum through the proximal opening, the passage and the distal opening to create a negative pressure in the interior of the vessel, opening the vessel flow opening into the interior of the vessel below the fluid level.

2. The method according to claim 1 wherein the method further includes the steps of adjusting the intensity of the vacuum applied to the vessel interior to obtain a desired flow or lack of flow through the vessel flow opening.

3. The method according to claim 2 wherein the step of adjusting the intensity includes the step of adjusting the size of an adjustable vacuum bleed opening extending through the adapter body and opening into the passage to whereby a portion of the vacuum applied at the proximal opening is bled off through the vacuum bleed opening.

4. The method of claim 3 further comprising the step of disposing a filter in the passage so that gas may pass through the passage, but fluid is substantially prevented from passing through the filter.

5. The method according to claim 3 wherein the step of adjusting the adjustable bleed opening includes the step of rotating at least partially concentrically disposed inner and outer sleeves relative to each other to selectively adjust the alignment between bleed holes extending through the inner and outer sleeves, respectively.

6. The method according to claim 5 wherein the step of adjusting further includes the step of limiting the range of relative motion between the inner and outer sleeves by way of disposing a post extending from an outer surface of the inner sleeve in a slot in outer sleeve.

7. The method of claim 1 further comprising the step of disposing a filter in the passage so that gas may pass through the passage, but fluid is substantially prevented from passing through the filter.

8. An adapter for connection to a first opening in a fluid containing vessel for applying a vacuum from a vacuum source to the interior of the vessel to maintain fluid therein when a second opening is created in the vessel, the adapter comprising:

a body having a proximal end and a distal end, and a passage extending therethrough, the passage having a proximal opening and a distal opening, the proximal opening of the body being configured for connection to a vacuum source and the distal end of the body being configured for sealing engagement of the distal opening with the first opening in the vessel such that the vacuum supplied from the vacuum source through the passage to the vessel creates a negative pressure within the vessel whereby the fluid is maintained in the vessel when the second opening is created.

9. The adapter according to claim 8 wherein the body further comprises an adjustable vacuum bleed opening extending through the body and opening into the passage whereby a portion of the vacuum applied at the proximal opening may be bled off through the vacuum bleed opening and the vacuum created at the distal opening may be varied by adjusting the size of the vacuum bleed opening.

10. The adapter according to claim 9 wherein the body comprises an outer sleeve having a side wall, and an inner sleeve having a side wall, the vacuum bleed opening comprising an opening extending through the side wall of the inner sleeve and an opening extending through the side wall of the outer sleeve, the inner sleeve being disposed at least partially within the outer sleeve and the inner and outer sleeves being rotatable relative to each other such that the extent to which the opening in the side wall of the inner sleeve and the opening in the side wall of the outer sleeve are aligned can be selectively adjusted to adjust the vacuum applied to the vessel through the distal opening of the body.

11. The adapter according to claim 10 further comprising a post extending from the side wall of the inner sleeve along an outer surface of the inner sleeve side wall which is disposed at least partially within the outer sleeve, the adapter further comprising a slot in the side wall of the outer sleeve, the slot being disposed about the post to limit the relative motion of the inner and outer sleeves.

12. The adapter according to claim 11 wherein the slot in the outer sleeve includes a plurality of notches for securing the inner and outer sleeves in different relative rotational positions.

13. The adapter according to claim 10 wherein a portion of the outer sleeve extends beyond the inner sleeve to form the distal end of the adapter.

14. The adapter according to claim 10 wherein a portion of the inner sleeve extends beyond the outer sleeve to form the proximal end of the adapter.

15. The adapter according to claim 10 further including a filter disposed within the passage, whereby the filter allows passage of gas while substantially preventing the passage of fluid from the vessel through the passage.

16. The adapter according to claim 8 wherein the distal end includes a plurality of rings extending from and encircling an outer surface of the distal end of the adapter whereby at least one of the rings engages the vessel to substantially seal the distal opening to the vessel first opening.

17. The adapter according to claim 16 wherein the rings vary in size.

18. The adapter according to claim 17 wherein the rings vary in size such that the rings become larger the farther they are positioned from the outlet opening.

19. The adapter according to claim 16 wherein the rings are constructed of a soft, resilient material.

20. The adapter according to claim 8 further including a filter disposed within the passage, whereby the filter allows passage of gas while substantially preventing the passage of fluid from the vessel through the passage.

* * * * *